United States Patent [19]

Sinclair

[11] 4,090,628

[45] May 23, 1978

[54] FORKLIFT CLAMPS

[75] Inventor: Stuart W. Sinclair, Lake Jackson, Tex.

[73] Assignee: Anderson, Clayton & Co., Houston, Tex.

[21] Appl. No.: 720,919

[22] Filed: Sep. 7, 1976

[51] Int. Cl.[2] ..... B66C 1/44

[52] U.S. Cl. ..... 214/655; 214/653; 294/87 R; 294/88; 294/104

[58] Field of Search ..... 294/86 R, 87 R, 88, 294/103 R, 104; 214/653, 655

[56] References Cited

U.S. PATENT DOCUMENTS

| | | | |
|---|---|---|---|
| 2,874,862 | 2/1959 | Farmer | 214/653 X |
| 3,127,209 | 3/1964 | Faust | 214/653 X |
| 3,252,609 | 5/1966 | Ellis | 214/653 X |
| 3,866,780 | 2/1975 | Miller | 214/655 |

*Primary Examiner*—Drayton E. Hoffman
*Assistant Examiner*—George F. Abraham
*Attorney, Agent, or Firm*—Fulbright & Jaworski

[57] ABSTRACT

A forklift clamp having first and second arms extending horizontally outwardly and having generally flat outsides and insides and a thin cross section whereby the arms may readily move into and out of small spaces. At least one of the arms is movable toward the other arm for supporting a load therebetween. At least one of the arms is pivotally connected at its inner end to a vertical frame and hydraulic power means rotates the pivoting arm about the pivot inwardly for moving the outer ends of the arms toward each other for uniformly distributing the gripping pressure of the flat insides of the arm on a load, and rotate the arm outwardly for providing an operating clearance between the outer ends of the arms and the load. Preferably, the arms are decreasingly tapering in thickness from the inner ends towards the outer ends for decreasing the operating clearance required. Preferably, the arms are supported in horizontal tracks which are rotated for rotating the arms. The arms may include a concavity in their insides equal to approximately one-sixth of the deflection of the outer ends of an arm when carrying a load to increase equalization of the gripping force.

14 Claims, 15 Drawing Figures

FORKLIFT CLAMPS

BACKGROUND OF THE INVENTION

It has long been desired in the use of forklift clamps to uniformly distribute the loading forces over the entire clamping surface of clamping arms which move together to grip a load, particularly to allow the clamp to handle a plurality of flat sided objects such as rectangular boxes. For example, the arms may be cambered in as in U.S. Pat. No. 2,819,113 to accommodate the deflection of the arms, but has the disadvantage of increasing the effective arm thickness thereby requiring increased operating clearances and is only effective in distributing the clamping forces at a single clamping pressure. Others in attempting to obtain a more uniform gripping pressure have used pivoting pads as in U.S. Pat. No. 2,674,387, or used springs as in U.S. Pat. No. 3,145,866. However, such devices generally require thicker arms thereby desirably increasing the required operating clearances, and are complicated in construction and expensive.

The present invention is directed to clamps for a lift truck in which the arms are generally rigid, single-piece members having generally flat straight outsides and insides and a thin cross section whereby the arms may readily move into and out of small spaces and at least one arm may be pivoted about its inner end inwardly towards the other arm for increasing the equalization of the gripping pressure of the flat insides of the arms from the inner ends to the outer ends of the arms. Furthermore, the arms may be rotated outwardly relative to each other for providing operating clearances between the outer ends of the arms and a load for allowing engaging or disengaging a load. While U.S. Pat. Nos. 2,370,528 and 2,491,805 disclose rotating one or both arms, they will not provide the objectives and advantages of the present device.

SUMMARY OF THE PRESENT INVENTION

The present invention is directed to a clamp for use on a lift truck for supporting one or more flat sided objects such as boxes.

It is one object of the present invention to provide a clamp having thin arms whereby the arms may readily move into and out of small clearance spaces by providing arms which are generally rigid, singular-piece members having generally flat outsides and insides and a thin vertical cross section. The flat outside surfaces are advantageous for back handing operations, the flat insides are arranged for gripping and supporting flat sided objects and more uniformly equalizing the gripping pressure of the flat sides of the arms from the inner ends to the outer ends of the arms.

Another object of the present invention is the provision of obtaining a uniformity of pressure across the inside clamping surfaces of the arms by providing means for rotating the inner end of at least one of the arms inwardly thereby moving the outer ends of the arms toward each other for increasing the equalization of the gripping pressure of the flat insides of the arms on a load. Furthermore, by rotating one of the arms relative to the other arm, the outwardly extending arms may initially be slightly diverging for providing an operating clearance between the outer ends of the arms and a load for allowing engaging or disengaging a load.

Still a further object of the present invention is the provision of decreasingly tapering the arms in thickness from the inner ends toward the outer ends thereby reducing the operating clearances required in using the clamp for engaging and disengaging loads.

Still a further object of the present invention is the provision of providing a concavity on the inside of the arms equal to approximately one-sixth of the deflection of the outer ends of an arm when carrying a load to obtain more uniform loading on the arms.

Still a further object of the present invention is the provision of a clamp for use on a lift truck for supporting one or more flat sided objects having a vertical frame for attachment to the lift truck, and first and second horizontal tracks pivotally connected to the frame for horizontal movement. First and second arms extend horizontally outwardly from the frame with the inner end of the first arm being movable in the first track and the inner end of the second arm being movable in the second track. Means are provided connected to the frame for moving the arms horizontally toward and away from each other. Means are connected to the frame and to the tracks for rotating the tracks horizontally thereby moving the outer ends of the arms toward each other for increasing the equalization of the gripping pressure on the insides of the arm on an object, and for rotating the tracks horizontally outwardly for moving the outer ends of the arms away from each other for allowing engaging or disengaging an object.

Still other and further objects, features and advantages will be apparent from the following description of presently preferred embodiments of the invention given for the purpose of disclosure and taken in conjunction with the accompanying drawings.

DESCRIPTION OF THE PREFERRED EMBODIMENTS

Figure 1:
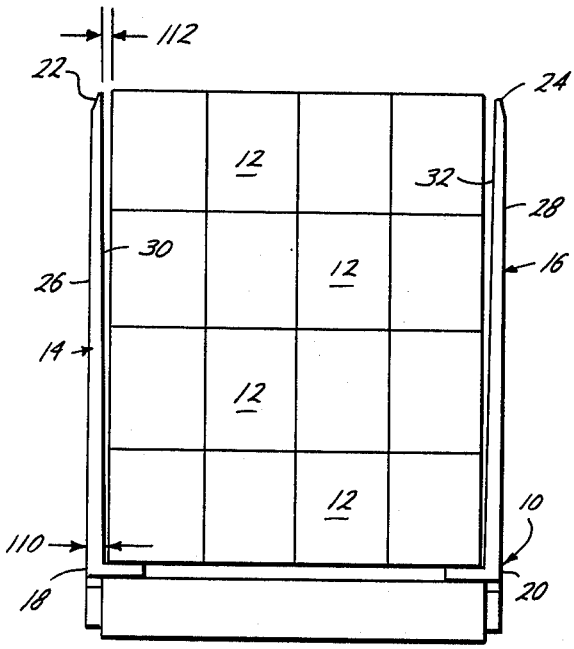
FIG. 1 is a schematic elevational view of the present invention in which the clamp is disengaged from the load.
Figure 2:
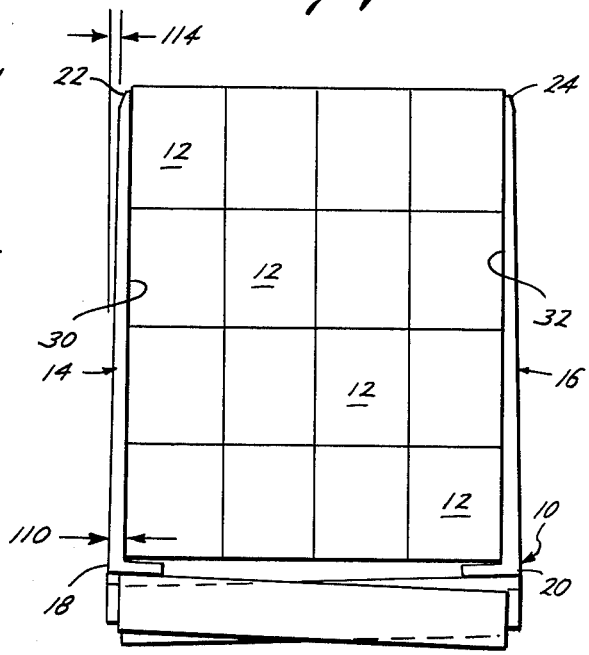
FIG. 2 is a view similar to FIG. 1 in which the clamp engages the load.

Referring now to the drawings, and particularly to FIGS. 1 and 2, the reference numeral 10 generally indicates the clamp of the present invention for use on a lift truck (not shown) for supporting one of more flat sided objects such as boxes 12. The clamp 10 includes generally rigid first arm 14 and second arm 16 extending horizontally outwardly. The arms 14 and 16 have inner ends 18 and 20, respectively, and outer ends 22 and 24, respectively. The arms 14 and 16 include outsides 26 and 28, respectively, and insides 30 and 32, respectively. One of the desirable features of a clamp is to have arms with a thin vertical cross section whereby the arms may readily move into and out of small spaces which is advantageous in use where a load of boxes 12 is being inserted or removed into or from other boxes 12. This is achieved in the present clamp 10 by providing the arms 14 and 16 with generally flat straight outsides 26 and 28, respectively, and generally flat straight insides 30 and 32, respectively. Furthermore, the flat straight outsides 26 and 28 are advantageous for use in back handing operations in which the outsides 26 and 28 are used for moving or straightening a plurality of objects such as boxes 12. By utilizing the flat insides 30 and 32 of the arms 14 and 16 as the gripping surfaces for engaging and supporting the objects 12, the single-piece arms 30 and 32 are devoid of the usual pivoting pads or spring-loaded pads and therefore the arms 14 and 16 may be made of a minimum cross-sectional thickness.

When the arms 14 and 16 are in the load engaging position, as shown in FIG. 2, it is desirable that the insides 30 and 32, particularly where the clamp 10 is engaging a plurality of objects 12, uniformly distribute the gripping forces over the entire clamping area of the arms 14 and 16 from the inner ends 18 and 20 to the outer ends 22 and 24. Obviously, if the gripping pressure of the insides 30 and 32 is not substantially equalized, some of the boxes 12 may be crushed, or some of the boxes 12 would not be securely supported.

However, when the arms 14 and 16 are supported from their inner ends 18 and 20, as will be more fully described hereinafter, the arms 14 and 16 generally act as a cantilevered beam. The arms 14 and 16 therefore are subject to deflection, even though they are generally rigid, in a horizontal plane when they are loaded. This deflection is similar to the vertical deflection of a vertically loaded cantilevered beam.

Figure 6:
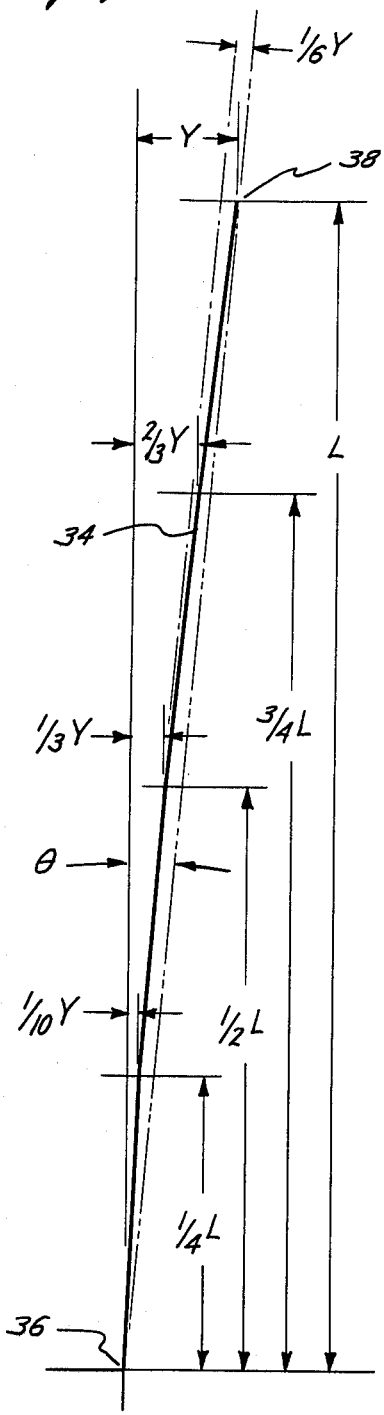
FIG. 6 is a schematic representation of the deflection in a cantilevered beam of uniform cross section with a uniformly distributed load illustrating certain problems involved with obtaining a uniformly distributed load in cantilevered clamp arms.

Referring now to FIG. 6, a cantilevered beam 34 is shown having an inner end 36 and an outer end 38 and is loaded with a uniformly distributed load. When uniformly loaded, the cantilevered beam 34 has a deflection from the horizontal and the outer end 38 is deflected from its normal position or the horizontal by an angle $\phi$ and the distance Y. The arms 14 and 16 in FIGS. 1 and 2 are similarly subjected to a deflection, but in a horizontal direction, when they are moved together to grip the boxes 12. And, of course, the deflection of the arms 14 and 16, if they are merely moved together parallel to each other, would cause a non-uniform loading of the insides 30 and 32 from the inner ends to the outer ends of the arms. That is, even though the arms 14 and 16 are relatively rigid, they will still have, to some extent, some deflection. One of the features of the present invention is the provision of means for rotating or cranking one or both of the arms 14 and 16 inwardly about an inner end toward the other arm to reduce the effect of deflection of the arms 14 and 16 to obtain a more uniform loading across the insides 30 and 32 of the arms 14 and 16, respectively.

Therefore, the present invention provides means which will be more fully described hereinafter, for rotating one or both of the arms 14 and 16 about their inner ends 18 and 20 from a non-loading engaging position, such as shown in FIG. 1, to a load engaging position on the boxes 12, as shown in FIG. 2, for increasing the equalization of the gripping pressure of the flat insides 30 and 32 from the inner ends 18 and 20 to the outer ends 22 and 24 on the boxes 12.

Referring now to FIGS. 3, 3A, 3B and 3C, one embodiment of the present invention is shown having a vertical frame 40 for attachment to a lift truck (not shown). At least one of the arms 14 and 16, and preferably both of the arms, are movable horizontally toward and away from each other in order to accommodate various sized loads. For example, the arms 14 and 16 may include horizontal tracks in which the inner ends 18 and 20 move. Thus, one or more tracks 42 and 44 are provided supported from the frame 40 and in turn support the inner end 18 of the arm 14. Similarly, one or more tracks 46 and 48 are supported from the frame 40 and in turn support the inner end 20 of arm 16. Thus, one or both of the arms 14 and 16 may be moved horizontally toward and away from the other arm by moving their inner ends in their respective tracks. For example, arm 14 may be provided with a piston and cylinder assembly 50 secured to one end 52 to the frame 40 and the second end 54 to the inner end 18 of the arm 14 for horizontally moving the arm 14 in the tracks 42 and 44.

Figure 3:
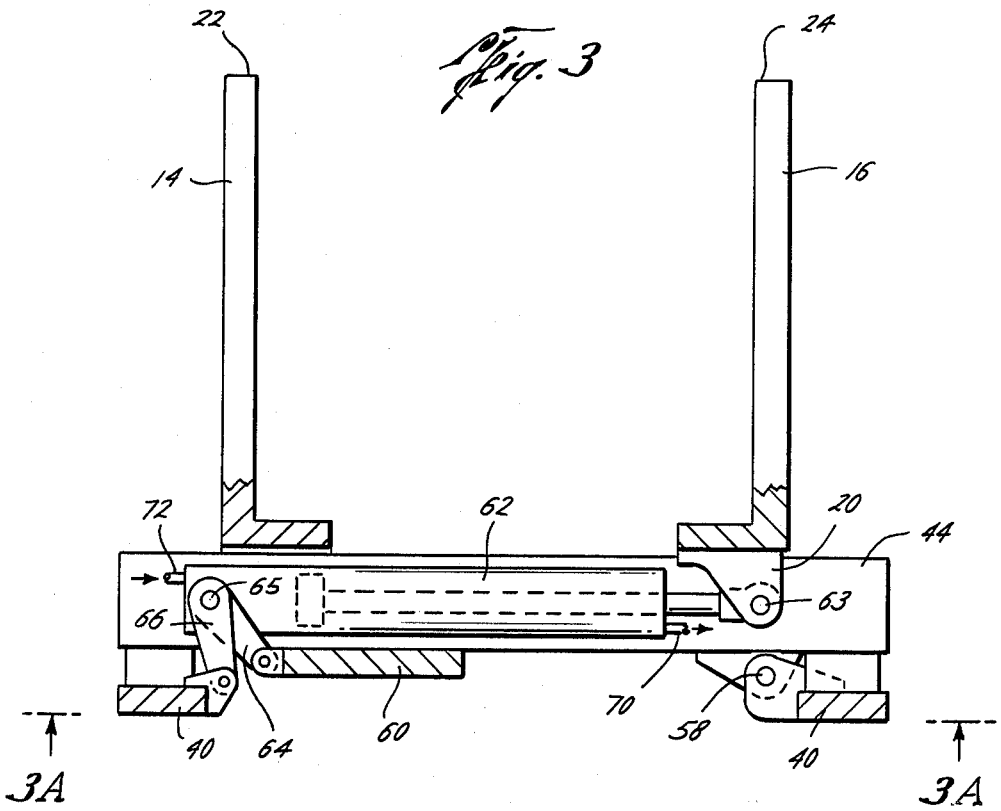
FIG. 3 is a cross-sectional view taken along the line 3—3 of FIG. 3A of one embodiment of the present invention with the clamp shown in the disengaged position.
Figure 3A:
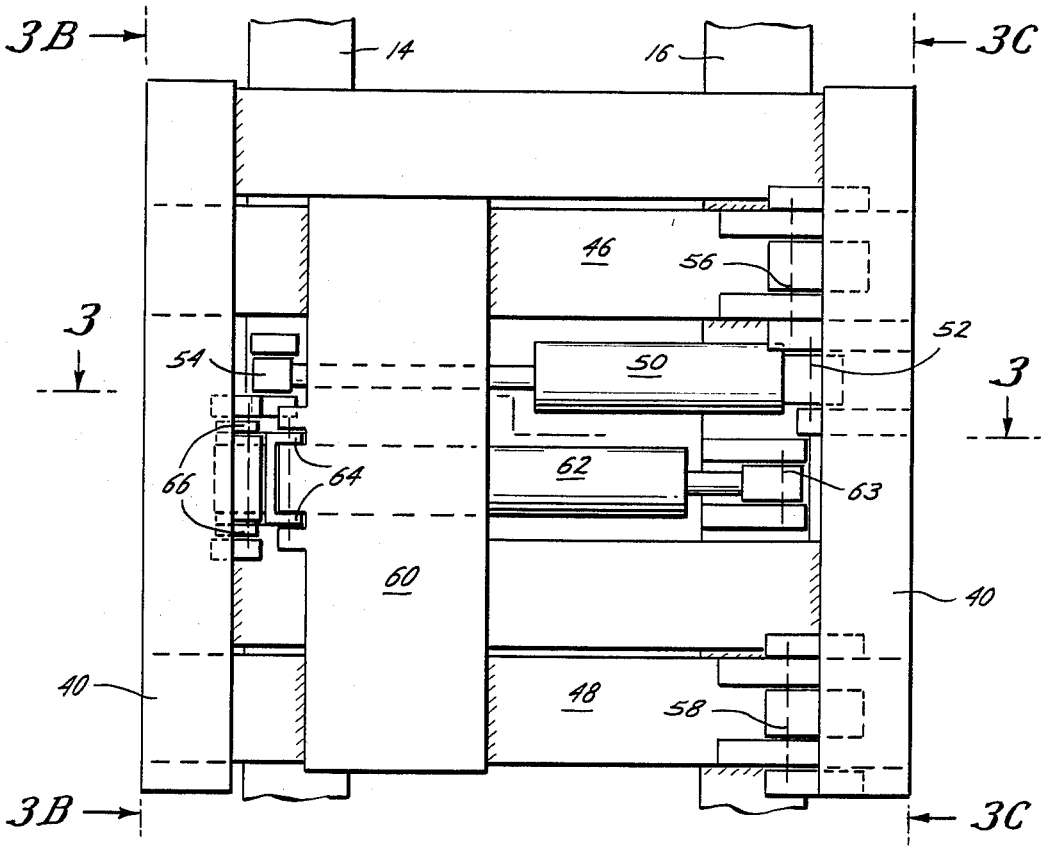
FIG. 3A is a view taken along the line 3A—3A of FIG. 3.
Figure 3B:
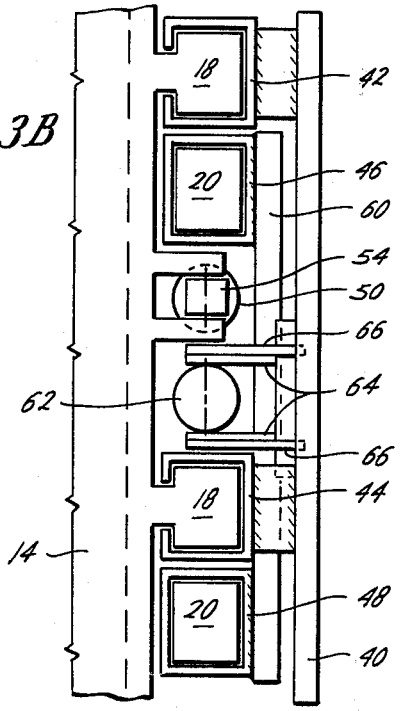
FIG. 3B is a view taken along the line 3B—3B of FIG. 3A.
Figure 3C:
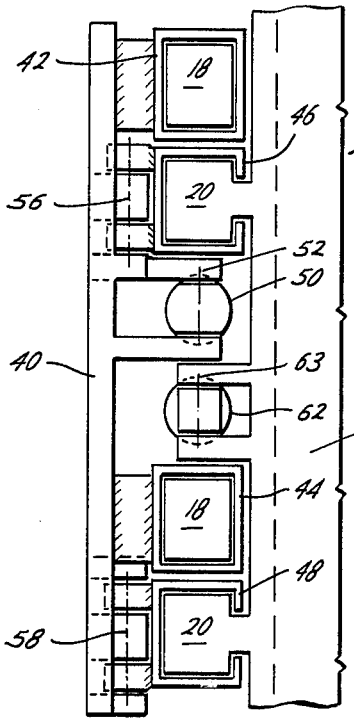
FIG. 3C is a view taken along the line 3C—3C of FIG. 3A.

As previously mentioned, means are provided for rotating at least one of said arms inwardly about its inner end thereby moving the outer ends 22 and 24 toward each other for increasing the equalization of the gripping pressure of the flat insides 30 and 32 on a load. As shown in FIGS. 3, 3A, 3B and 3C, the inner end of arm 16 is movable in tracks 46 and 48. In turn, the tracks 46 and 48 are pivotally connected by hinges 56 and 58 to the fixed vertical frame 40 whereby the tracks 46 and 48 and therefore the arm 16 may be rotated about the hinges 56 and 58 in a horizontal direction to move the outer end 24 of the arm 16 toward and away from the outer end 22 of the arm 14. As best seen in FIG. 3A, the back of the tracks 46 and 48 are connected together by member 60. Therefore, rotation of member 60 about pivot points 56 and 58 will rotate the tracks 46 and 48 and thus the outer end 24 of arm 16. Rotation of member 60 is provided by hydraulic piston and cylinder assembly 62, one end of which is connected by pivot pin 63 to the inner end 20 of the arm 16. The other end of the piston and cylinder assembly 62, such as the cylinder, is connected to both the member 60 and the fixed vertical frame 40 through toggle links 64 and 66, respectively. The toggle link 64 is pivotally connected at both ends between the piston and cylinder assembly 62 and the member 60 and toggle link 66 is pivotally connected at both ends between the piston and cylinder assembly 62 and the vertical frame 40. The piston and cylinder assembly 62 and its connecting structure not only acts to rotate the member 60, the tracks 46 and 48 and the arm 16, but also acts to move the arm 16 in the tracks 46 and 48. As shown in FIG. 3, the arm 16 has been shown moved to an open position, but since the piston can be moved further to the right, the arm 16 could be moved further away from the arm 14 in the tracks 46 and 48 to accommodate yet wider loads. In FIGS. 3, 3A, 3B and 3C, the cylinder of the piston and cylinder assembly 62 has moved as far to the left as it is able because of the limitations of toggle links 64 and 66 and, as shown, member 60 has been moved to one extent of travel for moving the end 24 of the arm 16 away from the end 22 of the arm 14.

Figure 4:
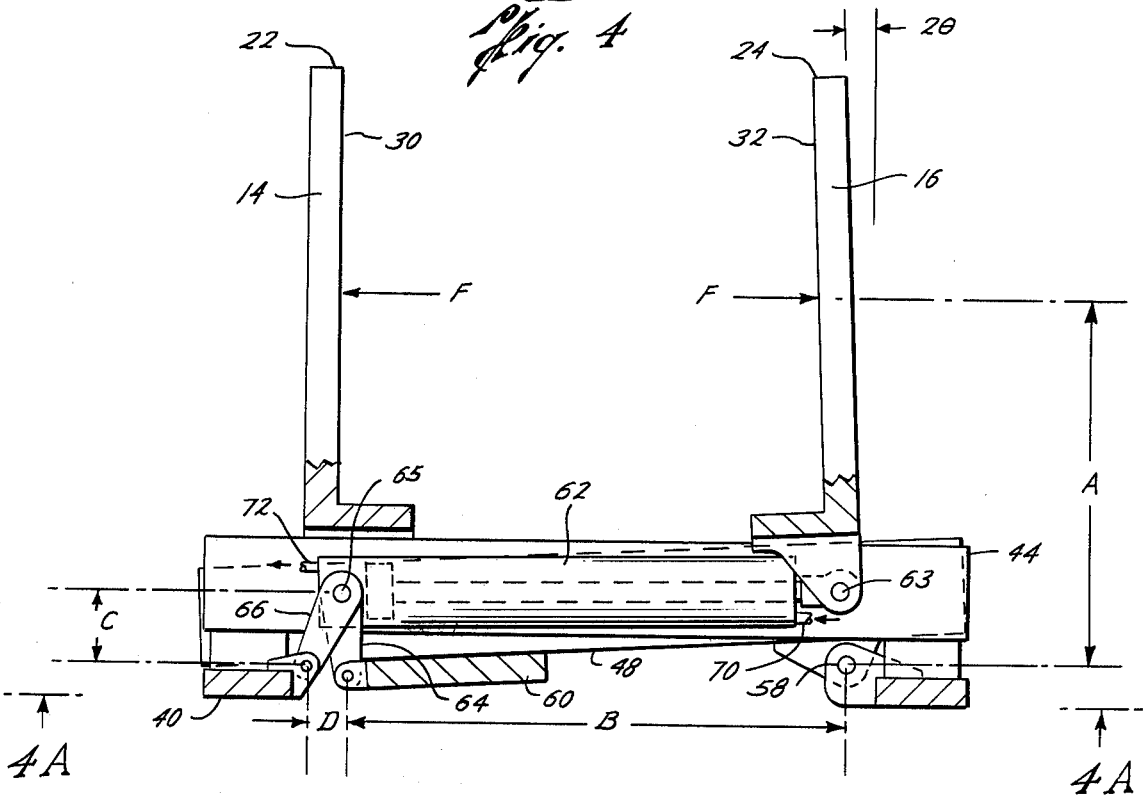
FIG. 4 is a view similar to FIG. 3 showing the clamp in position engaging a load.
Figure 4A:
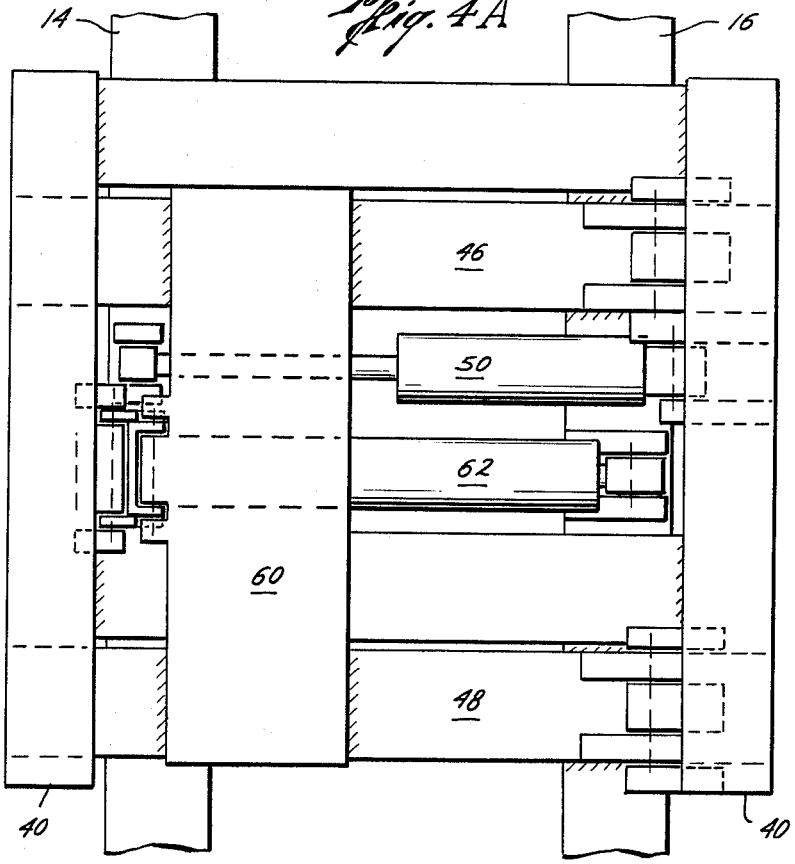
FIG. 4A is a view taken along line 4A—4A of FIG. 4 and is similar to FIG. 3A showing the clamp in a position engaging a load.

Assuming that the arms 14 and 16 of the apparatus shown in FIG. 4 were engaging a load and fluid was entering port 70 and leaving port 72, the piston and cylinder assembly 62 would be retracting drawing the arm 16 towards the arm 14 by moving pivot 65 and 63 together while limiting the extent of travel of pivot 65 by toggles 64 and 66. Also as best seen in FIGS. 4 and 4A, with a load engaged between the arms 14 and 16 and the pivot point 65 has moved to the right the toggle link 64 causes the member 60 to rotate about the pivot points 58 and 56 thereby rotating tracks 46 and 48 and the inner end 20 of the arms 16 about pivots 56 and 58. Therefore, the piston and cylinder assembly 62 not only moves the arms 14 and 16 towards each other, but rotates the outer end 24 of the arm 16 relative to the outer end 22 of the arm 14 to more uniformly distribute the gripping load on the insides 30 and 32 of the arms 14 and 16 along the arms. Preferably, if only the arm 16 is rotating to converge inwardly, then it is preferred that its angle of rotation shown in FIG. 4 be approximately equal to $2\theta$ where $\theta$ is the angle of deflection referred to in the discussion of FIG. 6. Since the piston and cylinder assembly 62 both moves the arms 14 and 16 toward and away from each other and rotates their outer ends 22 and 24 toward and away from each other, the piston 50 for moving the arm 14 may be omitted unless it is desired for providing a greater distance of movement of the arms 14 and 16 toward and away from each other to accommodate wider loads. Also, while cylinder 50 is connected to only laterally move the arm 14 and does not act to rotate the arm 14, the cylinder 50 could also be suitably connected to the arm 14 similar to the connection of piston and cylinder assembly 62 to the arm 16 for rotating the arm 14 as well as merely moving it laterally.

As has been described, the piston and cylinder assembly 62 has the capability of not only moving the arms 14 and 16 generally parallel toward and away from each other, but also has the capability of moving the ends 22 and 24 of the arms toward and away from each other. As one of the features of the present invention is the provision of uniformly distributing the gripping forces over the entire clamping surfaces 30 and 32 of the arms, this will result in a resultant vector force F as indicated by the arrow midway between the inner and outer ends of the arms 14 and 16. By proper selection of the sizes of linkages, the resultant force F can be designed to act midway between the inner and outer ends of the arms to provide the desired uniform load distribution. Therefore, when the proportion $A/B = C/D$, as shown in FIG. 4, the resultant force F will be midway between the ends of the arms and provide the desired more uniform distribution of gripping forces.

Figure 5:
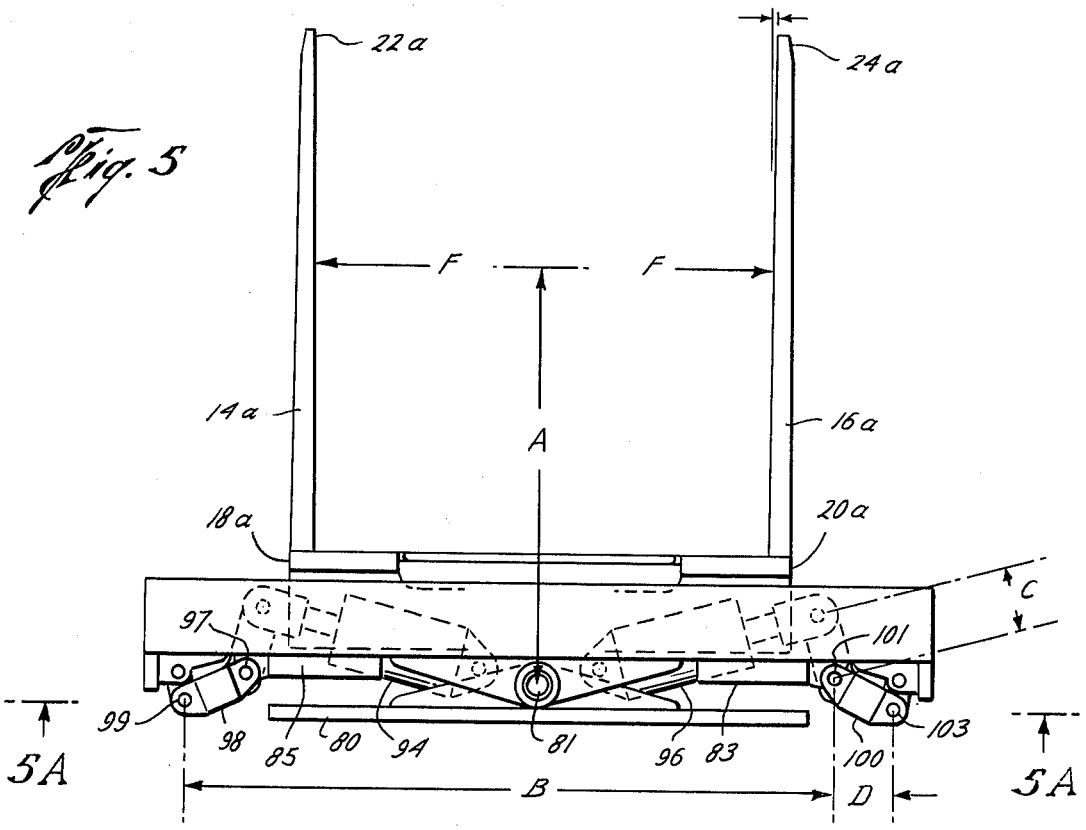
FIG. 5 is a cross-sectional view of another embodiment of the present invention shown with the arms in a non-engaging position.
Figure 5A:
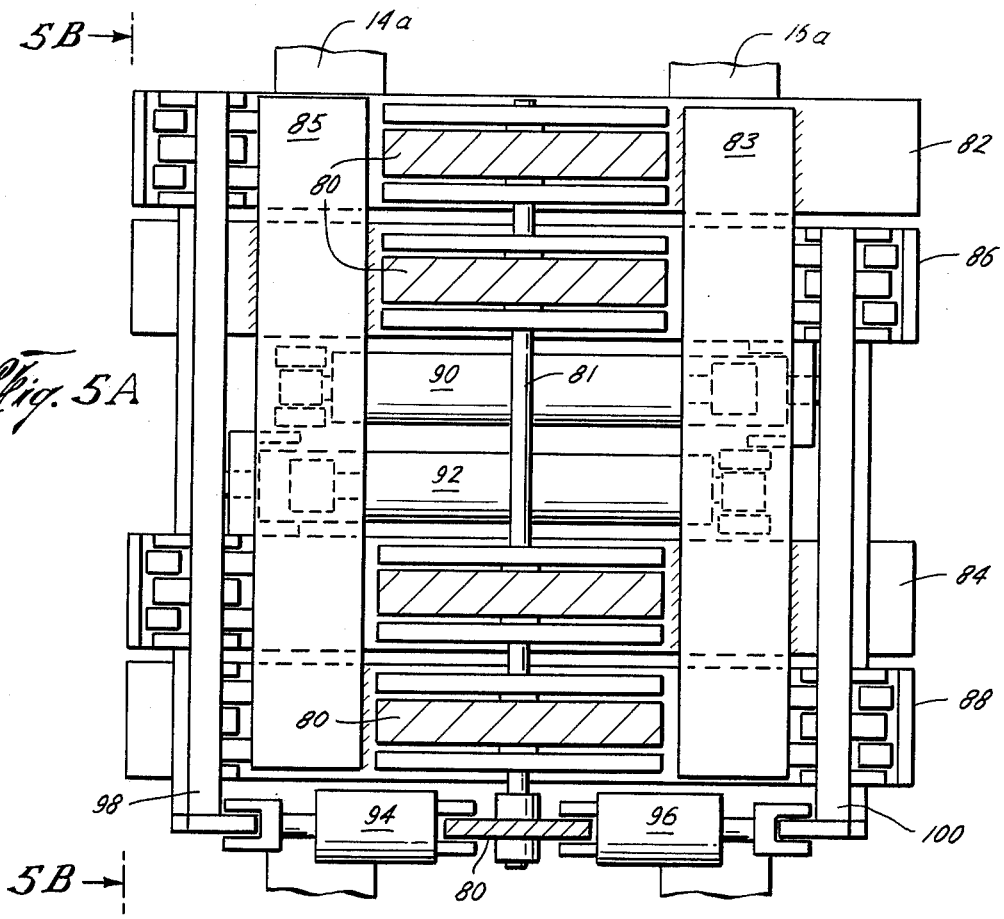
FIG. 5A is a view taken along the line 5A—5A of FIG. 5.
Figure 5B:
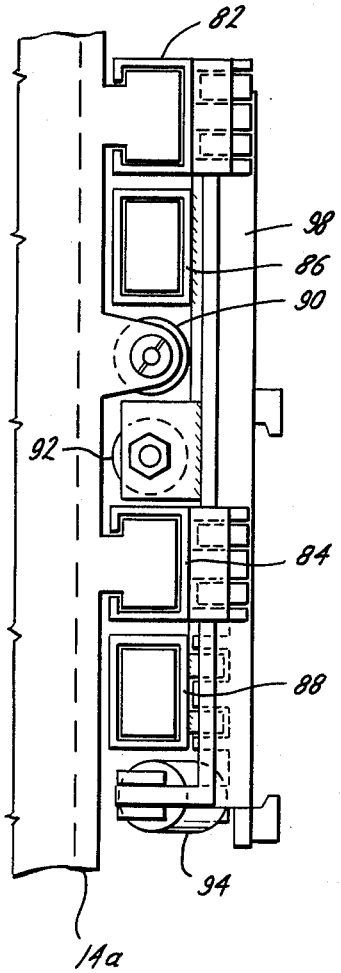
FIG. 5B is a view taken along the line 5B—5B of FIG. 5A.

Referring now to FIGS. 5, 5A nd 5B, another embodiment is illustrated in which a vertical frame 80 is provided for attachment to a lift truck (not shown) by means of a shaft 81. Tracks 82 and 84 are provided in which the inner end 18*a* of arm 14*a* transversely moves. Similarly, tracks 86 and 88 are provided in which the inner end 20*a* of arm 16*a* moves. Each of the tracks 82, 84, 86 and 88 is supported from the frame 80 by shaft 81 for horizontal movement. A member 83 is connected between tracks 82 and 83 causing the tracks 82 and 84, as well as arm 14*a* to rotate together. Similarly, a member 85 is connected between tracks 84 and 86 causing tracks 84 and 86 and arm 16*a* to rotate together. A piston and cylinder assembly 90 is provided, one end of which is connected to the member 83 and a second end of which is connected to the inner end 18*a* of arm 14*a* whereby the piston and cylinder assembly 90 moves the arm 14*a* toward and away from the arm 16*a*. Similarly, piston and cylinder assembly 92 is provided having one end connected to the member 85 and the second end connected to the inner end 20*a* of arm 16*a* whereby actuation of the piston and cylinder assembly 92 moves the arm 16*a* in the tracks 86 and 88 toward and away from the arm 14*a*. In this embodiment, separate means are provided for rotating the tracks for pivoting the outer arm ends 22*a* and 24*a* towards and away from each other. Such means may consist of hydraulic piston and cylinder assemblies 94 and 96, each of which has one end connected to the frame 80 and the second end to square bars 98 and 100, respectively, which are rotated in response to the actuation of the piston and cylinder assemblies 94 and 96, respectively. Shaft 98 is pivotally connected between member 85 and tracks 82 and 84 by pivots 97 and 99. Shaft 100 is pivotally connected between member 83 and tracks 86 and 88 by pivots 101 and 103. Rotation of either or both shafts 98 and 100 will rotate tracks 82 and 84 relative to tracks 86 and 88 about the shaft 81 for rotating the outer end 22*a* of arm 14*a* and the outer end 24*a* of arm 16*a* toward and away from each other. FIG. 5 is labeled with the dimensions A, B, C and D similarly to FIG. 4 to illustrate that by satisfying the equation $A/B = C/D$ the resultant force F carried by the arms 14*a* and 16*a* will be about midway the inner and the outer ends of the arms to provide the desired uniform load distribution.

The structure of the present clamp in which the outer ends 22 and 24 of the arms 14 and 16, respectively, are able to rotate toward and away from each other provides additional advantages. While rotating the arms 14 and 16, as best seen in FIG. 2 inwardly, to toe in the outer ends 22 and 24 to obtain more uniform load distribution is desirable for carrying a load, it is desirable that the outer ends 22 and 24 be diverging or toed out when engaging or disengaging a load in order to provide desired operating clearances. An additional feature of the present invention is the provision of a taper in the arms 14 and 16 decreasing in thickness from the inner ends 18 and 20, respectively, to the outer ends 22 and 24, respectively. Referring now to FIGS. 1 and 2, the advantages of the combination of using thin arms, with a taper, and rotating the arms, provides effective and desirable operating clearances in loading and unloading objects in close spaces such as adjacent walls or adjacent objects. In FIG. 1, the maximum arm thickness is 110 but with the thin flat outsides and insides and the taper, the arms still provide an operating clearance 112 when the arms are rotated outwardly or toed outwardly which allows the clamp 10 to move into position about a plurality of objects 12 or to disengage a plurality of objects 12 without interference. And as best seen in FIG. 2, a maximum arm thickness, when the arms are rotated inwardly, is still 110 and in such operating position an outside operating clearance 114 is provided which is useful in allowing the clamp 10 to insert the load into close quarters by providing an outside taper without increasing the arm thickness.

Figure 7:
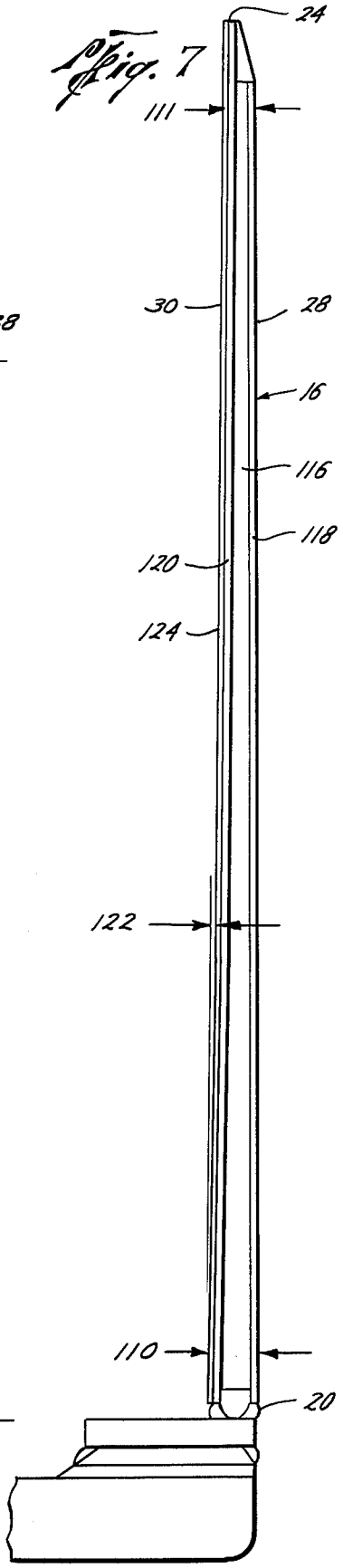
FIG. 7 is an enlarged elevational view of one of the clamp arms.

Referring again to FIG. 6, it is noted that there is an inward deflection of the cantilevered beam 32 from angle $\theta$ at approximately midway of the beam 34 of an amount approximately equal to one-sixth Y. Therefore, even though the beam 34 is rotated upwardly an angle $\theta$, the beam 34 will still have a curvature from a straight line of one-sixth Y which will detract from its uniform gripping ability. Therefore, another feature of the present invention is to include a concavity on the insides 30 and 32 of the arms 14 and 16, respectively, approximately equal to one-sixth of the deflection of the outer ends 22 and 24 of the arm when carrying a load which will increase the equalization of uniform loading along the insides 30 and 32 of the arms 14 and 16, respectively. Referring now to FIG. 7, an enlarged elevational view of one of the arms 16 is shown. Preferably, the arms include a plurality of horizontally extending ribs 116, an outside panel 118, and an inside panel 120. A slight concavity 122 is provided on the inside 30 of the arm 16 approximately one-third of the way from the inner end 20 and in the amount of approximately one-sixth Y. The concavity 122 is very slight and while it does not detract from the characterization of the surface 30 as a flat surface, does act to increase the uniform loading along the inside surface 30. In one example, the length of the arm 16 is 48 inches, its maximum thickness 110 at its inner end 20 is one and one-half inches, and due to the taper of the inside 30, the thickness 111 near the outer end 24 is 1 inch, and the deflection 122 (1/6 Y) is only one-eight of an inch. Preferably, a rubber covered surface 124 is applied to the inside surfaces 28 and 30 of the arms 14 and 16 for increased gripping ability.

Typically, the vertical height of the arms 14 and 16 are substantially the same, for example, with a 48 inch length, the vertical height in one embodiment was also 48 inches, thereby insuring that the clamp 10 would substantially uniformly grip the outer surfaces of a plurality of boxes 12, from top to bottom as well as from front to back, as best seen in FIG. 2.

The present invention, therefore, is well adapted to carry out the objects and attain the ends and advantages mentioned as well as others inherent therein. While presently preferred embodiments of the invention have been given for the purpose of disclosure, numerous changes in the detail of construction and arrangement of parts may be provided without departing from the spirit and the scope of the invention as hereinafter claimed.

What is claimed is:

1. A clamp for use on a lift truck for supporting one or more flat sided objects comprising, a vertical frame for attachment to the lift truck, first and second arms extending horizontally outwardly from the frame and supported from the frame, said arms being single piece members having inner and outer ends and having generally flat outsides and insides extending from the inner ends to the outer ends and a thin cross section whereby the arms may readily move into and out of small spaces, means connected to the frame for moving at least one of the arms horizontally toward the other arm, at least the first arm being pivotally connected at its inner end to the frame, means for rotating said pivoting arm about said pivot inwardly includes a hydraulic cylinder, pivoting linkage connected between the means for moving one of the arms horizontally and to the first arm, for simultaneously moving the outer ends of the arms by rotation and horizontal movement towards each other for increasing the equalization of the gripping pressure of the flat insides of the arms on a flat sided object from the inner ends to the outer ends of the arms, and outwardly for providing an operating clearance between the outer ends of said arms and objects for allowing engaging or disengaging an object.

2. The apparatus of claim 1 wherein said arms decreasingly taper in thickness from the inner ends toward the outer ends.

3. The invention of claim 2 wherein the insides of said arms are tapered.

4. The invention of claim 1 wherein the vertical height of the arms is substantially equal to horizontal length of said arms.

5. The invention of claim 1 wherein the generally flat arms include a slight concavity in their insides equal to approximately one-sixth of the deflection of the outer ends of an arm when carrying a load.

6. A clamp for use on a lift truck for supporting one or more flat sided objects comprising, a vertical frame for attachment to the lift truck, at least one horizontal track pivotally connected to said frame for horizontal movement, first and second arms extending horizontally outwardly from the frame and supported from the frame, said arms being single-piece members having inner and outer ends and having generally flat insides and a thin cross section whereby the arms may readily move into and out of small spaces, at least one of said arms having its inner end movable in said track, means connected to the frame for movin at least one of the arms horizontally toward the other arm, means connected between the frame and the track for rotating said track about the pivot for rotating said arm movable in said track inwardly toward the second arm for increasing the equalization of the gripping pressure of the flat insides of the arms from the inner ends to the outer ends of the arms on a flat sided object, and outwardly for providing an operating clearance between the outer ends of said arms and objects for allowing engaging or disengaging said objects.

7. The apparatus of claim 6 wherein said arms decreasingly taper in thickness from the inner ends toward the outer ends.

8. The apparatus of claim 6 wherein the arms include a concavity in their insides equal to approximately one-sixth of the deflection of the outer ends of the arms when carrying a load.

9. A clamp for use on a lift truck for supporting one or more flat sided objects comprising, a vertical frame for attachment to the lift truck, first and second horizontal tracks pivotally connected to said frame for horizontal movement, first and second arms extending horizontally outwardly from said frame, said arms being generally rigid single-piece members having inner and outer ends and having generally flat insides for supporting one or more flat sided objects therebetween, the inner end of the first arm being movable in the first track, and the inner end of the second arm being movable in the second track, means connected to the frame for moving said arms horizontally toward and away from each other, means connected to the frame and to said tracks for rotating said tracks horizontally for moving the outer ends of the arms toward each other for increasing the equalization of the gripping pressure of the flat insides of the arms on an object, and for rotating said tracks horizontally for moving the outer ends of the arms away from each other for allowing engaging or disengaging an object.

10. A clamp for use on a lift truck for supporting one or more flat sided objects comprising, a vertical frame for attachment to the lift truck, first and second arms extending horizontally outwardly from the frame and supported from the frame, said arms being single piece members having inner and outer ends and having generally flat outsides and insides and a thin cross section whereby the arms may readily move into and out of small spaces, at least one of the arms including a horizontal track in which said one arm moves, said track being pivotally connected to said frame for horizontal movement, a hydraulic piston and cylinder assembly having a coacting piston and cylinder, one of the piston and cylinder being connected to said one arm for moving said one arm horizontally toward the other arm, a pivoting linkage connected between the other of the piston and cylinder and both of the frame and said track for rotating said track horizontally from said frame for rotating said one arm inwardly toward the second arm for increasing the equalization of the gripping pressure of the flat insides of the arms on an object from the inner ends to the outer ends of the arms.

11. The apparatus of claim 10 wherein said pivoting linkage includes, a first link pivotally connected between one of said piston and cylinder assembly and said frame, and a second link pivotally connected between one of said piston and cylinder assembly and said track.

12. The apparatus of claim 11 wherein the pivoting linkage is sized to rotate the arms toward each other at approximately twice the angle that one of the arms would be deflected while carrying a load.

13. A clamp for use on a lift truck for supporting one of more flat sided objects comprising, a vertical frame for attachment to the lift truck, first and second horizontal tracks pivotally connected to said frame for horizontal movement, first and second arms extending horizontally outwardly from said frame, said arms being generally rigid single-piece members having inner and outer ends and having generally flat insides for supporting one or more flat sided objects therebetween, and having flat outsides and a thin cross section whereby the arms may readily move into and out of small spaces, the inner end of the first arm being movable in the first track, and the inner end of the second arm being movable in the second track, said arms decreasingly tapering in thickness from the inner ends toward the outer ends, hydraulic piston and cylinder assembly means connected between the frame and each of the arms for moving said arms horizontally toward and away from each other, hydraulic piston and cylinder assembly means connected to the frame and to each of the tracks for rotating said tracks horizontally in a direction for moving the outer ends of the arms towards each other for increasing the equalization of the gripping pressure of the flat insides of the arms on an object, and for rotating said tracks horizontally in a direction for moving the outer ends of the arms away from each other for allowing engaging or disengaging an object.

14. The invention of claim 13 wherein the arms include a concavity in their insides equal to approximately one-sixth of the deflection of the outer ends of an arm when carrying a load.

* * * * *

UNITED STATES PATENT OFFICE

CERTIFICATE OF CORRECTION

Patent No. 4,090,628 Dated May 23, 1978

Inventor(s) Stuart W. Sinclair

It is certified that error appears in the above-identified patent and that said Letters Patent are hereby corrected as shown below:

Column 1, line 20, delete "desirably" and insert --undesirably--

Column 3, line 7, delete "of" and insert --or--

Column 3, line 55, delete "ø" and insert -- θ --

Column 4, line 30, delete "to" and insert --at--

Column 5, line 60, delete "nd" and insert --and--

Column 8, line 35, add "g" after "movin"

Column 10, line 6, delete "of" and insert --or--

Signed and Sealed this

Seventh Day of November 1978

[SEAL]

*Attest:*

RUTH C. MASON
*Attesting Officer*

DONALD W. BANNER
*Commissioner of Patents and Trademarks*